US010207894B2

(12) United States Patent
Benosman

(10) Patent No.: US 10,207,894 B2
(45) Date of Patent: Feb. 19, 2019

(54) CONTROLLING SWAY OF ELEVATOR CABLE WITH MOVEMENT OF ELEVATOR CAR

(71) Applicant: Mitsubishi Electric Research Laboratories, Inc., Cambridge, MA (US)

(72) Inventor: Mouhacine Benosman, Boston, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 89 days.

(21) Appl. No.: 15/460,964

(22) Filed: Mar. 16, 2017

(65) Prior Publication Data

US 2018/0265327 A1 Sep. 20, 2018

(51) Int. Cl.

| | |
|---|---|
| ***B66B 1/28*** | (2006.01) |
| ***B66B 7/06*** | (2006.01) |
| ***B66B 9/00*** | (2006.01) |

(52) U.S. Cl.

CPC ..... *B66B 1/28* (2013.01); *B66B 7/06* (2013.01); *B66B 9/00* (2013.01); *B66B 2201/00* (2013.01); *B66B 2201/404* (2013.01)

(58) Field of Classification Search

CPC ..... B66B 1/28; B66B 7/06
USPC ..... 187/247
See application file for complete search history.

(56) References Cited

U.S. PATENT DOCUMENTS

| | | | | |
|---|---|---|---|---|
| 5,509,503 | A * | 4/1996 | Salmon | B66B 11/08 187/266 |
| 9,045,313 | B2 * | 6/2015 | Benosman | B66B 7/06 |
| 9,096,411 | B2 * | 8/2015 | Benosman | B66B 7/06 |
| 9,242,838 | B2 * | 1/2016 | Benosman | B66B 7/06 |
| 9,278,829 | B2 * | 3/2016 | Benosman | B66B 7/06 |
| 9,434,577 | B2 * | 9/2016 | Benosman | B66B 5/02 |
| 9,475,674 | B2 * | 10/2016 | Benosman | B66B 7/06 |
| 9,862,570 | B2 * | 1/2018 | Benosman | B66B 7/06 |
| 9,875,217 | B2 * | 1/2018 | Benosman | B66B 5/0018 |

(Continued)

FOREIGN PATENT DOCUMENTS

| | | |
|---|---|---|
| EP | 2628697 A2 | 8/2013 |
| JP | 2033078 A | 12/2014 |

(Continued)

*Primary Examiner* — David Warren
(74) *Attorney, Agent, or Firm* — Gene Vinokur; Hironori Tsukamoto; James McAleenan

(57) ABSTRACT

An elevator system includes an elevator car supported by an elevator rope wrapped around a sheave, such that a rotation of the sheave changes a length of the elevator rope between the sheave and the elevator car thereby controlling a movement of the elevator car within an elevator shaft of the elevator system. An elevator cable is connected to the elevator car and the elevator shaft to carry electrical signals to the elevator car. The operation of the elevator system is controlled in response to receiving a call for a movement of the elevator car requesting a change of the length of the elevator rope. A motion profile of the elevator car causing the requested change of the length of the elevator rope that minimizes the sway of the cable is determined according to a model of a cable relating a sway of the cable to a motion profile. Next, the motion of the elevator car is controlled according to the determined motion profile.

15 Claims, 8 Drawing Sheets

(56) References Cited

U.S. PATENT DOCUMENTS 9,914,619 B2 * 3/2018 Roberts ..... B66B 5/022
2012/0125720 A1 * 5/2012 Roberts ..... B66B 7/068 187/393
2013/0048438 A1 * 2/2013 Mangini ..... B66B 7/06 187/414
2013/0133983 A1 * 5/2013 Mangini ..... B66B 7/06 187/277
2013/0173206 A1 * 7/2013 Benosman ..... B66B 7/06 702/141
2013/0213742 A1 * 8/2013 Hakala ..... B66B 1/24 187/247
2013/0275081 A1 * 10/2013 Benosman ..... B66B 7/06 702/150
2013/0300335 A1 * 11/2013 Benosman ..... G05B 5/01 318/561
2013/0304236 A1 * 11/2013 Benosman ..... B66B 1/32 700/31
2014/0000985 A1 1/2014 Fukui
2014/0069747 A1 * 3/2014 Benosman ..... B66B 7/06 187/414
2014/0124300 A1 * 5/2014 Benosman ..... B66B 7/06 187/247
2014/0166406 A1 * 6/2014 De Jong ..... B66B 7/10 187/264
2014/0224590 A1 * 8/2014 Puranen ..... B66B 5/022 187/247
2015/0008075 A1 * 1/2015 Benosman ..... B66B 7/06 187/247
2015/0027814 A1 * 1/2015 Benosman ..... B66B 7/06 187/247
2015/0166304 A1 * 6/2015 Roberts ..... B66B 5/022 187/278
2016/0244298 A1 * 8/2016 Roberts ..... B66B 5/022
2016/0272463 A1 * 9/2016 Benosman ..... B66B 5/0018
2017/0260025 A1 * 9/2017 Benosman ..... B66B 7/06
2018/0265327 A1 * 9/2018 Benosman ..... B66B 1/28

FOREIGN PATENT DOCUMENTS

JP 2106586 A 12/2014
WO 2013153881 A1 10/2013

* cited by examiner

510

| | |
|---|---|
| First Length of change | First motion profile |
| Second Length of change | Second motion profile |
| Third Length of change | Third motion profile |

FIG. 5

CONTROLLING SWAY OF ELEVATOR CABLE WITH MOVEMENT OF ELEVATOR CAR

TECHNICAL FIELD

This invention relates generally to elevator systems, and more particularly to reducing a sway of an elevator electrical cable in an elevator system using movement of the elevator car.

BACKGROUND

Typical elevator systems include an elevator car, e.g., for moving passengers between different floors of the building and a counterweight moving along guiderails in a vertical elevator shaft above or below ground. The car and the counterweight are connected to each other by hoist cables referred herein as elevator ropes. The hoist cables are wrapped around a grooved sheave located in a machine room at the top or bottom of the elevator shaft. The sheave can be moved by an electrical motor, or the counterweight can be powered by a linear motor. Furthermore, the car receives control signals and power signals through a set of electrical cables which have one side attached to the bottom of the elevator car and the opposite side attached to the elevator shaft usually at the mid distance between the top and the bottom position of the elevator car in the elevator shaft.

The sway of the cables refers to an oscillation of the cables, e.g., electrical cables, in the elevator shaft. The oscillation can be a significant problem in an elevator system. The oscillation can be caused, for example, by wind induced building deflection and/or the vibration of the cables during operation of the elevator system. If the frequency of the vibrations approaches or enters a natural harmonic of the cables, then the oscillations can be greater than the displacements. In such situations, the cables can tangle with other equipment in the elevator shaft or get structurally weaker over time, and the elevator system may be damaged.

Various conventional methods control the sway of the elevator cables. For example, the method described in Japan Patent JP2033078A a passive damping mechanical system is added to the elevator shaft at one side of the elevator cables where they attach to the elevator shaft. The passive mechanical system applies a brake to the cables motion which reduced their motion and thus reduces their vibration. Similarly, in the Japan Patent JP2106586A two passive mechanical systems are added to the elevator cables system to damp out their vibrations. One roller-like mechanical system is mounted at the point of connection between the elevator cables and the elevator shaft with a motion of the rollers along the elevator shaft wall, i.e. perpendicular to the vibration of the elevator cables.

Another similar passive mechanical system is mounted under the elevator car at the point of attachment of the elevator cables and the elevator car. This mechanical system includes a roller-like device forcing the cables to move in the axis of vibrations of the elevator cables. Such a mechanical system allows the two extremities of the elevator cables to move in two perpendicular directions, and the brake applied to the rollers damps out the motion of the elevator cables to reduce its vibrations.

However, the passive damping systems increase the cost of the elevator systems and usually configured in advanced reducing their flexibilities.

SUMMARY

It is an objective of some embodiments to provide a system and a method for reducing a sway of an elevator cable connected to an elevator car in an elevator system by shaping the movement of the elevator car between floors. It is another objective of some embodiments to provide a motion profile of the elevator car that reduces the sway of the elevator cable with or without knowing an external disturbance acting on an elevator system. It is another objective of some embodiments to reduce the computational requirements for the determination of such a motion profile.

Some embodiments are based on a realization that vertical movement of the elevator car induces an extra dynamical terms in the cable equations, that counteracts the cable sway due to external disturbances on the building. If the car vertical motion between floors is properly planned, then the movement of the elevator car can be used to reduce the cable sway. For example, in some embodiments, the movement of the elevator car is controlled by causing a main sheave of the elevator system to change a length of the elevator rope of the elevator car. Thus, the sway of the elevator car can be reduced without the usage of any actuators.

Some embodiments are based on recognition that a model of an elevator cable can include a sway of the elevator cable and an external disturbance acting on the cable that causes the sway. Some embodiments are based on the realization that such an external disturbance includes a controlled disturbance caused by the movement of the elevator car and an uncontrolled disturbance, e.g., a force of the wind inducing vibration of the building and/or the elevator system installed in the building. Thus, when the uncontrolled disturbance is fixed, e.g., using a measured value or bounded by a maximum value, such a cable model unambiguously relates a sway of the cable to the controlled disturbance caused by the movement of the elevator car.

During a normal operation of the elevator system, the movement of the elevator car is typically performed in response to a service call requesting the elevator car to change its position from a current position to a different position in the elevator shaft. For example, the elevator car can be requested to move in response to a hall call to accept a passenger, and/or in response to a car call for moving the passenger to a desired floor.

The elevator car is supported by an elevator rope wrapped around a sheave, such that a rotation of the sheave changes a length of the elevator rope between the sheave and the elevator car thereby controlling a movement of the elevator car within an elevator shaft of the elevator system. To that end, the request for the movement of the elevator car necessitates a change of the length of the elevator rope. Also, the movement of the elevator car can be defined by a rate of change of the length of the elevator rope as a function of time. In such a manner, the model of the cable can relate a sway of the cable to a rate of change of the length of the elevator rope from its current length to the requested changed length. Because the rate of change of the length of the elevator rope is strongly dependent on the movement of the elevator car, such a rate of change is referred herein as a motion profile of an elevator car, which can be defined by one or combination of the length, the velocity, and the acceleration of the elevator rope as a function of time.

To that end, various embodiments determine the motion profile of the elevator car causing the requested change of the length of the elevator rope that minimizes the sway of the cable according to the model of the cable and move the elevator car according to the determined motion profile.

Some embodiments are based on another realization that when the uncontrolled disturbance is bound by a maximal value, different motion profiles for different change of the length of the rope can be predetermined off-line. This realization simplifies the computational requirements of the processor of the elevator system. For example, it allows for selecting, using the requested change of the length of the elevator rope, the motion profile from a memory storing a mapping between different motion profiles and different values of modification of the length of the elevator rope.

Some embodiments determine the motion profile by solving an optimization problem minimizing a cost function of the sway of the cable subject to constraints defined by the model of the cable. The optimization is typically an iterative process that requires the processors of those embodiments to meet a minimum computational requirements. However, alternative embodiments simplify these requirements by assuming that the motion profile follows a predetermined pattern. Such a pattern restricts the variations of the motion profile simplifying the optimization.

For example, in one embodiment, the motion profile is defined by a profile of the acceleration of the elevator car having a predetermined pattern. To that end, the processor of the embodiment determines the parameters of the predetermined pattern, which is simpler that the general optimization. Example of such a pattern includes a constant acceleration section followed by a zero acceleration section followed by a constant deceleration section. For this example, the parameters include a slope of the acceleration, a slope of deceleration, and the length of each segment.

For example, one embodiment minimizes a cost function representing the maximum cable sway over the car travel time interval, under the constraints of the cable model, and the car start and end positions. In such embodiment the optimization variables can be the parameters of the car motion profile, for example, a slope of the acceleration, a slope of deceleration, and the length of each segment.

Furthermore, in one implementation, this optimization can be realized offline, where the results of the optimization process for different car motions between different floors, which correspond to different rope lengths' changes, is stored in a table and then used later online when the elevator is required to travel between these different floors.

For example, if the elevator is called to travel between floor one and floor ten, then the controller, which regulates the car motion, extracts the optimal motion profile of the elevator car for this specific floors request, and then use this motion profile to move the elevator car from floor one to floor ten, with minimal cable sway.

Accordingly, one embodiment discloses a method for controlling an operation of an elevator system including an elevator car supported by an elevator rope wrapped around a sheave, such that a rotation of the sheave changes a length of the elevator rope between the sheave and the elevator car thereby controlling a movement of the elevator car within an elevator shaft of the elevator system, and at least one elevator cable connected to the elevator car and the elevator shaft to carry electrical signals to the elevator car, wherein the method uses a processor coupled with stored instructions implementing the method, wherein the instructions, when executed by the processor carry out at least some steps of the method.

The method includes receiving a call for a movement of the elevator car requesting a change of the length of the elevator rope; accessing a model of a cable relating a sway of the cable to a motion profile of an elevator car defining one or combination of the length, a velocity, and an acceleration of the elevator rope as a function of time; determining the motion profile of the elevator car causing the requested change of the length of the elevator rope that minimizes the sway of the cable according to the model of the cable; and controlling the motion of the elevator car according to the determined motion profile.

Another embodiment discloses an elevator system including an elevator car supported by an elevator rope wrapped around a sheave, such that a rotation of the sheave changes a length of the elevator rope between the sheave and the elevator car thereby controlling a movement of the elevator car within an elevator shaft of the elevator system; a motor to control a rotation of the sheave changing the length of the elevator rope; at least one elevator cable connected to the elevator car and the elevator shaft; at least one input interface for accepting a request of the elevator car to move from a current position in the elevator shaft to a different position necessitating a change of the length of the elevator rope; a memory to store a model of a cable as a function of a sway of the cable and a motion profile of an elevator car defining one or combination of the length, a velocity, and an acceleration of the elevator rope as a function of time; and a controller including a processor to determine the motion profile of the elevator car causing the requested change of the length of the elevator rope that minimizes the sway of the cable according to the model of the cable, and to cause the motor to rotate the sheave and to move the elevator car according to the determined motion profile.

Yet another embodiment discloses a non-transitory computer readable storage medium embodied thereon a program executable by a processor for performing a method, wherein the memory stores a set of analytical functions and a set of cost functions corresponding to a set of patterns of elementary paths, each pattern represents a continuous path, each analytical function is determined for a corresponding pattern to provide an analytical solution for input states of the vehicle defining a continuous path connecting the input states by a sequential compositions of the elementary paths following the corresponding pattern, and each cost function is determined to provide a cost of the corresponding pattern indicative of a cost of the motion of the vehicle according to the continuous path connecting the input states and represented by the corresponding pattern. The method includes receiving a call for a movement of the elevator car requesting a change of the length of the elevator rope; accessing a model of a cable relating a sway of the cable to a motion profile of an elevator car defining one or combination of the length, a velocity, and an acceleration of the elevator rope as a function of time; determining the motion profile of the elevator car causing the requested change of the length of the elevator rope that minimizes the sway of the cable according to the model of the cable; and controlling the motion of the elevator car according to the determined motion profile.

BRIEF DESCRIPTION OF THE DRAWINGS

FIG. 5 shows an example of a mapping between different motion profiles and different values of modification of the length of the elevator rope according to some embodiments.

DETAILED DESCRIPTION

Figure 1A:
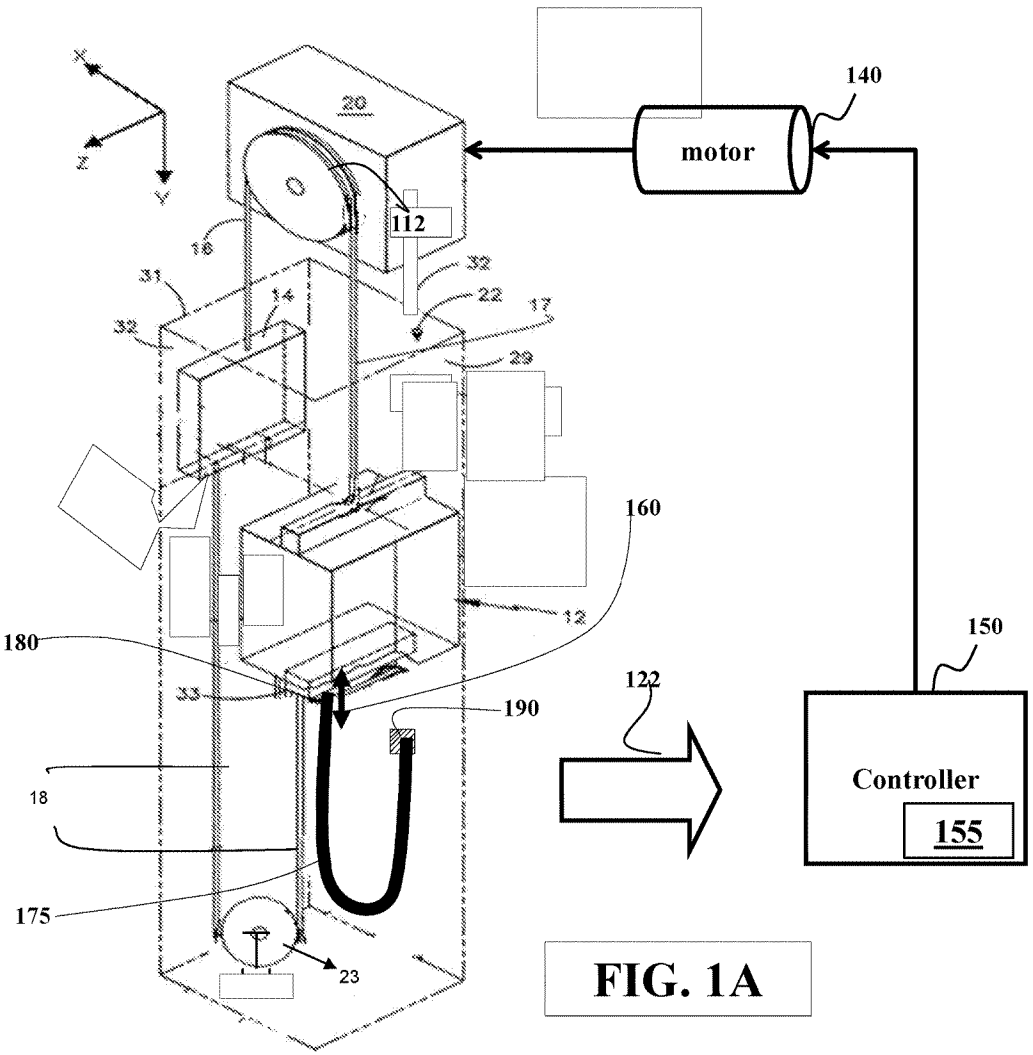
FIG. 1A shows a schematic of an elevator system according to some embodiments.

FIG. 1A shows a schematic of an elevator system according to some embodiments. The elevator system includes an elevator car 12 connected by at least one elevator ropes to different components of the elevator system. For example, the elevator car and a counterweight 14 connect to one another by main ropes 16-17, and compensating ropes 18. The elevator car 12 can include a crosshead 30 and a safety plank 33. The electrical signals and/or commands are carried to the elevator car by at least one elevator cable 175 connected to the car 12 and the elevator shaft at an attachment point 190.

The elevator car 12 supported by the elevator rope 16 wrapped around a sheave 112. The rotation of the sheave 112 changes a length of the elevator rope between the sheave and the elevator car to control a movement of the elevator car within an elevator shaft of the elevator system. The rotation of the sheave changing the length of the elevator rope can be controlled by a motor 140 connected to the sheave and/or to a pulley 20. The pulley 20 for moving the elevator car 12 and the counterweight 14 through an elevator shaft 22 can be located in a machine room (not shown) at the top (or bottom) of the elevator shaft 22. The elevator system can also include a compensating pulley 23. An elevator shaft 22 includes a front wall 29, a back wall 31, and a pair of side walls 32.

The elevator car and the counterweight have a center of gravity at a point where summations of the moments in the x, y, and z directions are zero. In other words, the elevator car 12 or counterweight 14 can theoretically be supported and balanced at the center of gravity (x, y, z), because all of the moments surrounding the center of gravity point are cancel out. The elevator ropes 16-17 typically are connected to the crosshead 30 of the elevator car 12 where the coordinates of the center of gravity of the car are projected. The elevator ropes 16-17 are connected to the top of the counterweight 14 the coordinates of the center of gravity of the counterweight 14 are projected.

During the operation of the elevator system, different components of the system are subjected to internal and external disturbance, e.g., sway due to wind, resulting in lateral motion of the components. Such lateral motion of the components can result in a sway of the elevator cables 175 that needs to be reduced.

Some embodiments are based on recognition that a model of an elevator cable can include a sway of the elevator cable and an external disturbance acting on the cable that causes the sway. Some embodiments are based on realization that such an external disturbance includes a controlled disturbance caused by the movement of the elevator car and an uncontrolled disturbance, e.g., a force of the wind inducing vibration of the building and/or the elevator system installed in the building. Thus, when the uncontrolled disturbance is fixed, e.g., using a measured value or bounded by a maximum value, such a cable model unambiguously relates a sway of the cable to the controlled disturbance caused by the movement of the elevator car.

Figure 1B:
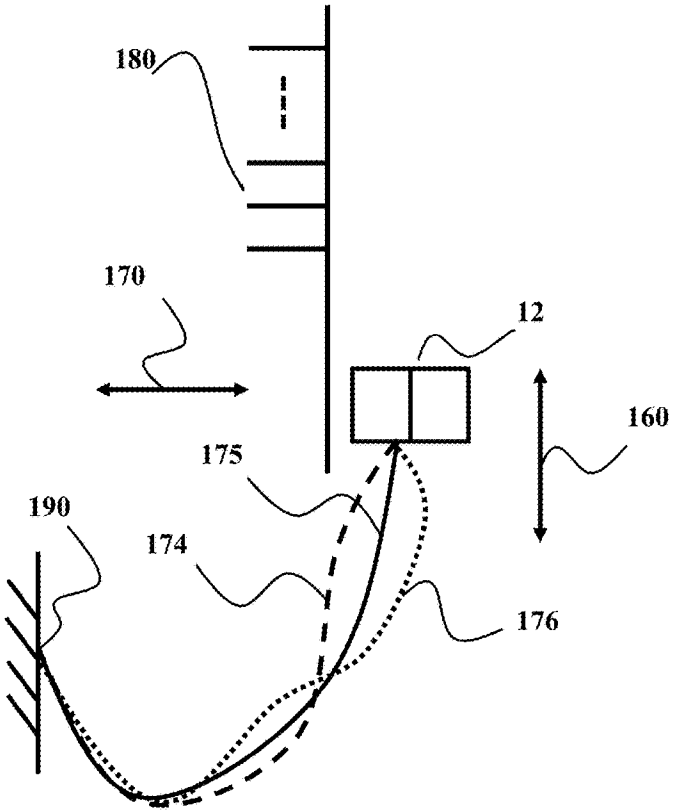
FIG. 1B shows a schematic of application of different forces to the elevator cable 175 during the motion 160 of the elevator car 12 between floors 180, according to some embodiments.

FIG. 1B shows a schematic of application of different forces to the elevator cable 175 during the motion 160 of the elevator car 12 between floors 180, according to some embodiments. The external disturbances on the building with the elevator system exert a disturbance force 170 on the elevator cable 175. The disturbance force 170 changes the nominal shape of the elevator cable 175 to a current shape 176. Similarly, the motion 160 is the controlled disturbance that also acts on the cable 175.

Some embodiments of the invention are based on recognition that it is possible to apply another force on the cable to counteract the effect of the disturbance force on the shape of the elevator cable. In addition, various embodiments of the invention are based on a realization that the car motion between the building floors can be used to apply such a counter force and to reduce the sway of the elevator cable in an elevator system. Some embodiments are based on realization that the inverse shape of the elevator cable can be derived indirectly from a model of the elevator cable attached to the elevator car.

To that end, the controller 150 includes a processor 155 configured to determine an optimal motion of the elevator car which creates a counter force on the elevator cable required to change a nominal shape of the elevator cable to a shape 174 that is inverse of a current shape 176 of the elevator cable caused by disturbance on the elevator system, and to cause the motor 140 to rotate the sheave 112 and to move 160 the elevator car 12 with an acceleration that applies the counter force to the elevator cable.

During a normal operation of the elevator system, the movement of the elevator car is typically performed in response to a service call requesting the elevator car to change its position from a current position to a different position in the elevator shaft. For example, the elevator car can be requested to move in response to a hall call to accept a passenger, and/or in response to a car call for moving the passenger to a desired floor.

The elevator car is supported by an elevator rope wrapped around a sheave, such that a rotation of the sheave changes a length of the elevator rope between the sheave and the elevator car thereby controlling a movement of the elevator car within an elevator shaft of the elevator system. To that end, the request for the movement of the elevator car necessitates a change of the length of the elevator rope. Also, the movement of the elevator car can be defined by a rate of change of the length of the elevator rope as a function of time. In such a manner, the model of the cable relates a sway of the cable to a rate of change of the length of the elevator rope from its current length to the requested changed length. Because the rate of change of the length of the elevator rope is strongly dependent on the movement of the elevator car, such a rate of change is referred herein as a motion profile of an elevator car, which can be defined by one or combination of the length, the velocity, and the acceleration of the elevator rope as a function of time.

To that end, various embodiments determine the motion profile of the elevator car causing the requested change of the length of the elevator rope that minimizes the sway of the cable according to the model of the cable and move the elevator car according to the determined motion profile.

Figure 2:
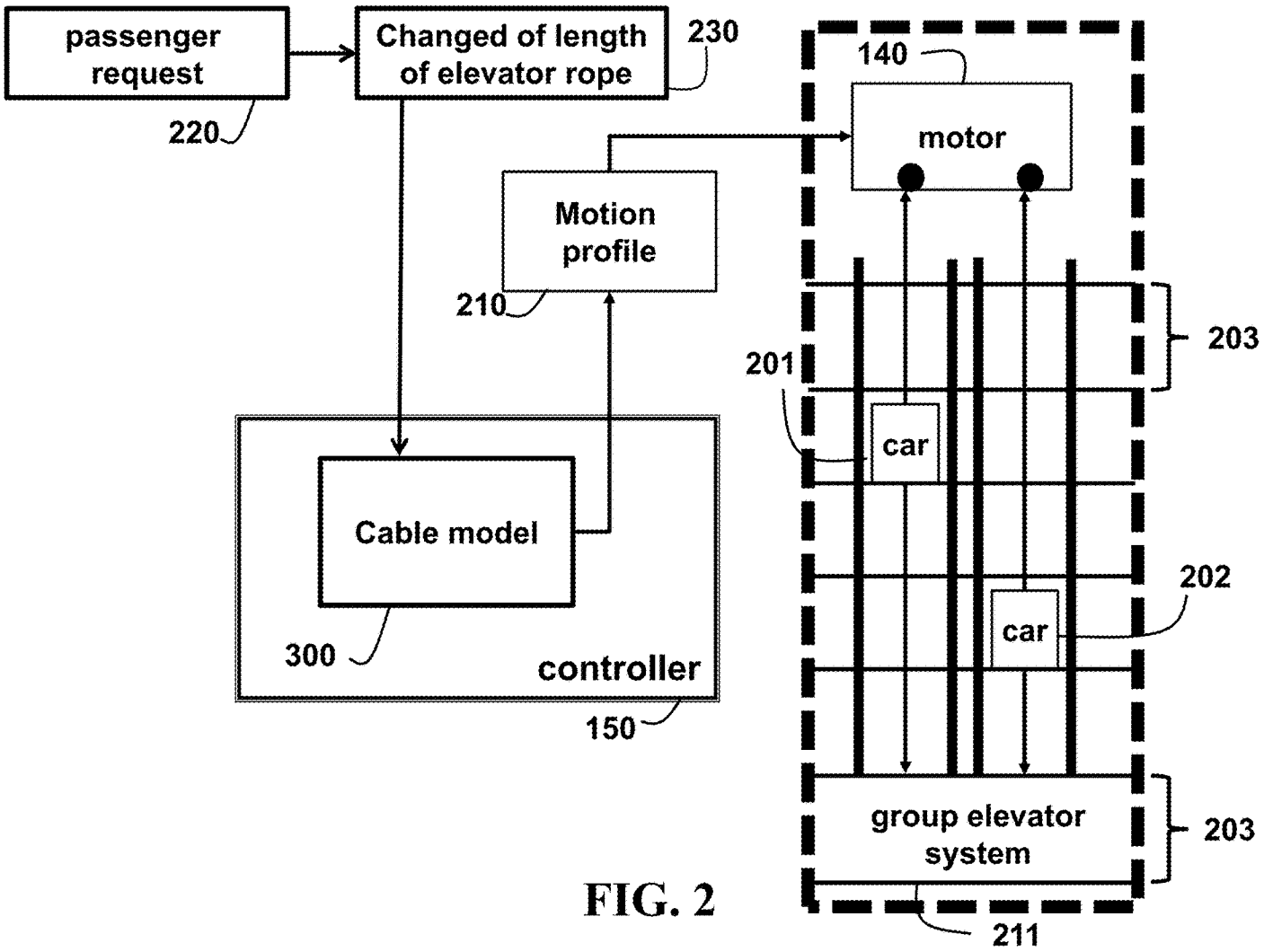
FIG. 2 is a schematic illustrating the control of one or several elevator cars 201-202 in a group elevator system 211 in a building having multiple floors 203, according to some embodiments.

FIG. 2 is a schematic illustrating the control of one or several elevator cars 201-202 in a group elevator system 211 in a building having multiple floors 203, according to some embodiments. The elevator system includes at least one input interface 220 for accepting a request of the elevator car to move from a current position in the elevator shaft to a different position. Such a request necessitates a change of the length of the elevator rope 230. The change 230 can be determined based on heights of the floors and on a number of floor that elevator car needs to travel for its current position to a requested position. Typically, the calculation of the change of the elevator rope for specific motion between the floors is configured as part of the installation of the elevator system.

The controller 150 determine the motion profile 210 of the elevator car causing the requested change of the length of the elevator rope that minimizes the sway of the cable 175 according to the model of the cable 300 stored in a memory operatively connected to the processor 155. Next, the controller causes the motor 140 to rotate the sheave and to move the elevator car according to the determined motion profile 210. As used herein, a model of a cable 300 as a function of a sway of the cable 175 and a motion profile of an elevator car 210 defining one or combination of the length, a velocity, and an acceleration of the elevator rope as a function of time.

Figure 3:
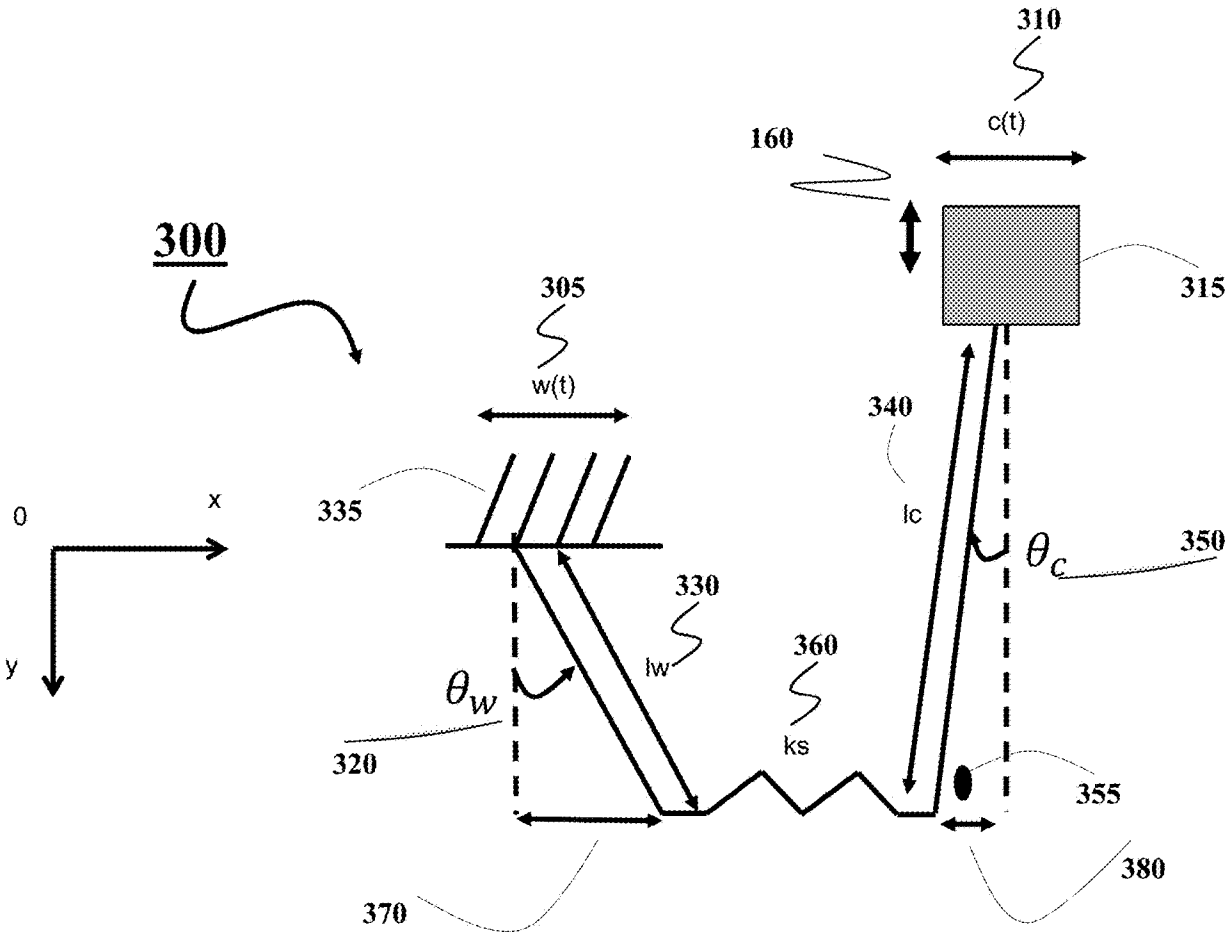
FIG. 3 shows a schematic of a model 300 of cable of the elevator system according to some embodiments.

FIG. 3 shows a schematic of a model 300 of cable of the elevator system according to some embodiments. The model of the elevator cable is designed based on parameters of the elevator system. The parameters and the models of other elevator systems can be similarly derived. Various methods can be used to formulate the model of the cable as a function of the sway 370, 380 of the elevator cable caused by the disturbances 305 and the motion of the elevator car 160.

For example, in one embodiment, the elevator cable is modeled as a two rigid segments 330, 340 coupled with a compliant spring 360. One side of the cables is attached to the car 315, and the other side is attached to the elevator shaft 335. The external disturbance on the system, e.g., from wind, is modeled with w(t)305 at the wall-side and with c(t)310 at the car-side, the cable sways are directly proportional to the angular variable 350 at the car-side, and the angular variable 320 at the wall-side.

This embodiment is advantageous because of its simplicity and low computations requirements. Indeed, other more complicated models might be developed for this system. For instance, embodiment uses a lumped model, which discretized the cables to several small spring-damper elements connected to each other to form a cable and then writes the dynamical models for each element. However, this approach leads to a complicated model with large number of variables, which is not suitable for real-time simulations and control. Another way to design a model for the elevator cable system, is to use an infinite dimension model for each cable, which is mathematically presented in the form of a partial differential equation (PDE). However, solving PDE's online is computationally expensive.

For example, in one embodiment the model of the elevator cables is determined by an ordinary differential equation (ODE) according to $$m_w l_w^2 \ddot{\theta}_w = -m_w l_w g \sin(\theta_w) - c_w l_w^2 \dot{\theta}_w - 2 m_w l_w \dot{l}_w \dot{\theta}_w - F_s l_w \cos(\theta_w) - m_w \ddot{w} l_w \cos(\theta_w);$$

$$m_c l_c^2 \ddot{\theta}_c = -m_c l_c g \sin(\theta_c) - c_c l_c^2 \dot{\theta}_c - 2 m_c l_c \dot{l}_c \dot{\theta}_c - F_s l_c \cos(\theta_c) - m_c l_c^{(2)} l_c \sin(\theta_c);$$

$$F_s = k_s(l_c \sin(\theta_c) + l_w \sin(\theta_w)). \quad (1)$$

Parameters of the Equation (1) include:

$m_c$ (kg) is the mass of the car-side segment of the cable.

$l_c, l_w$ (m) are the lengths of the car-side segment of the cable, and the wall-side segment, respectively.

$\theta_c, \theta_w$ (rad) are the angles of the car-side segment of the cable, and the wall-side segment, respectively.

$\dot{\theta}_c, \dot{\theta}_w$ (rad/sec) are the angular velocities of the car-side segment of the cable, and the wall-side segment, respectively.

$\ddot{\theta}_c, \ddot{\theta}_w$ (rad/sec$^2$) are the angular accelerations of the car-side segment of the cable, and the wall-side segment, respectively.

$c_c, c_w$ (N·sec/m) are the damping coefficients, e.g., laminar flows (air damping coefficient), of the car-side segment of the cable, and the wall-side segment, respectively.

$k_s$ (N/m) is the spring stiffness coefficient of the coupling spring between the car-side segment of the cable and the wall-side segment of the cable, and w(t) (m) is the horizontal displacement disturbance at the wall boundary point.

The absolute cables sway is given by $$u_w(y,t) = \tan(\theta_w) y + w(t); \text{ and}$$

$$u_c(y,t) = \tan(\theta_c) y + c(t).$$

wherein: $u_w(y, t)$ is the cables sway at the elevator shaft side and $u_c(y, t)$ is the cables sway at the elevator car side at the vertical position y.

If the state vector X defined as $$X = (\theta_\omega, \dot{\theta}_\omega, \theta_c, \dot{\theta}_c)'$$

The model of the cable can be written as $$\dot{X} = F(X, \ddot{\omega}(t), l_c^{(2)}, l_c^{(1)}, l_c)$$

where $$F = \begin{pmatrix} X_2 - (2 m_w l_w i_w X_2 + c_w l_w^2 X_2 + F_s l_w \cos(X_1) + m_w \ddot{w} l_w \cos(X_1) + m_w g l_w \sin(X_1)) // (m_w l_w^2) \\ X_4 - (2 m_c l_c i_c X_4 + c_c l_c^2 X_4 + F_s l_s \cos(X_3) + m_c l_c^{(2)} l_c \sin(X_3) + m_c g l_c \sin(X_3)) / (m_c l_c^2) \end{pmatrix}$$

$$l_\omega = L - d - l_c$$

$$i_\omega = -i_c,$$

To eliminate the control variable double integrals $\dot{l}_c$ and $l_c$, some embodiments proceed to an extended state representation $$\tilde{X} = (l_c, l_c^{(1)})'$$

with $$\dot{\tilde{X}} = (\tilde{X}_2, U)'.$$

One embodiment defines the extend state vector $$Z = (X', \tilde{X}')' \in \mathbb{R}^6$$

to obtain the extend space representation of the cable dynamics $$\dot{Z} = \begin{pmatrix} F(X, \ddot{\omega}, U, Z_5, Z_6) \\ Z_6 \\ U \end{pmatrix}$$

Figure 4:
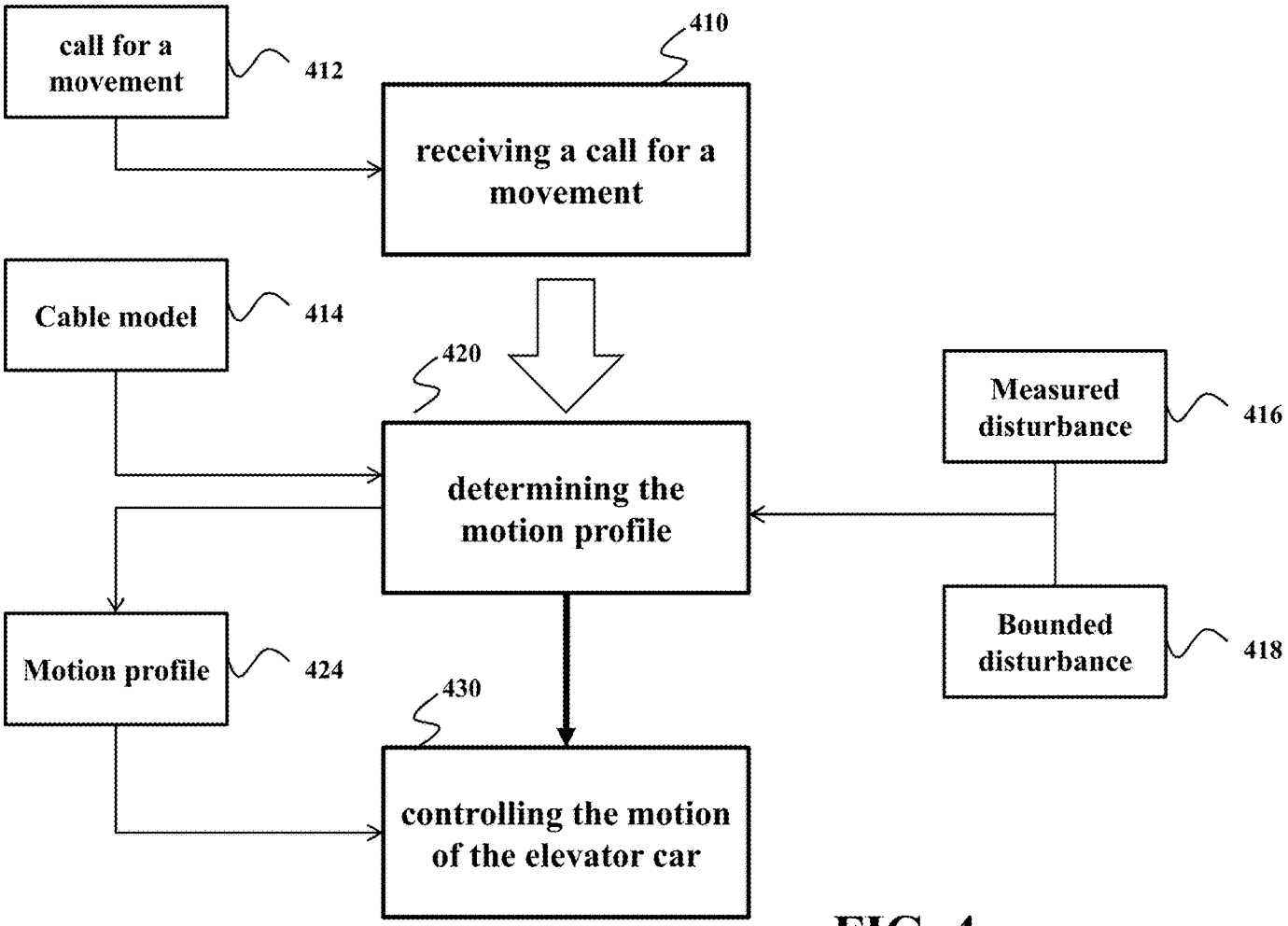
FIG. 4 shows a block diagram of a method for controlling an operation of an elevator system according to some embodiments.

FIG. 4 shows a block diagram of a method for controlling an operation of an elevator system according to some embodiments. The method uses a processor, e.g., the processor 155, coupled with stored instructions implementing the method. The instructions, when executed by the processor carry out at least some steps of the method.

In response to receiving 410 a call 412 for a movement of the elevator car requesting a change of the length of the elevator rope, the method access a model of a cable 414 relating a sway of the cable to a motion profile of an elevator car defining one or combination of the length, a velocity, and an acceleration of the elevator rope as a function of time and determines 420 the motion profile of the elevator car causing the requested change of the length of the elevator rope that minimizes the sway of the cable according to the model of the cable. Next, the method controls the motion of the elevator car according to the determined motion profile.

In various embodiments, the model of the cable includes a disturbance on the elevator system. For example, one embodiment determines the disturbance 416 on the elevator system using a sensor measuring an acceleration of a sway of the building and solves an optimization problem minimizing a cost function of the sway of the cable subject to constraints defined by the model of the cable to produce the motion profile.

For example, to reduce the cable sway using the elevator car motion, some embodiments minimize the following cost function:

$$J(t,U,Z):\mathbb{R}\times\mathbb{R}\times\mathbb{R}^6\rightarrow\mathbb{R}$$

with respect to the control time function U(t): $\mathbb{R}\rightarrow\mathbb{R}$ over a finite time interval $[t_0, \vec{t}_f]\subset\mathbb{R}$.

Ideally, we want to solve the optimal control problem $$\mathrm{Min}_U J(t,U,Z)$$

under the state dynamical constraints $$\dot{Z}=\begin{pmatrix} F(X,\ddot{\omega},U,Z_5,Z_6) \\ Z_6 \\ U \end{pmatrix}$$

the boundary conditions $$Z(t_0)=(X'(t_0),\tilde{X}'(t_0))',$$

$$Z(t_f)=(X'(t_f),\tilde{X}'(t_f))'$$

with the state and control constraints $$|Z_5(t)|\leq l_c(t_f),|Z_6(t)|\leq \dot{l}_{c_{max}},t\in[t_0,t_f]$$

$$|U(t)|\leq \ddot{l}_{c_{max}},t\in[t_0,t_f].$$

Additionally, or alternatively, some embodiments use a bound on the value of the disturbance 418.

Some embodiments are based on another realization that when the uncontrolled disturbance is bound by a maximal value 418, different motion profiles for different change of the length of the rope can be predetermined both on-line during the operation of the elevator system as well as off-line. This realization simplifies the computational requirements of the processor of the elevator system. For example, it allows for selecting, using the requested change of the length of the elevator rope, the motion profile from a memory storing a mapping between different motion profiles and different values of modification of the length of the elevator rope.

FIG. 5 shows an example of a mapping between different motion profiles and different values of modification of the length of the elevator rope according to some embodiments. The embodiments use the requested change of the length of the elevator rope to retrieve from the memory the corresponding motion profile.

Some embodiments determine the motion profile by solving an optimization problem minimizing a cost function of the sway of the cable subject to constraints defined by the model of the cable. The optimization is typically an iterative process that requires the processors of those embodiments to meet a minimum computational requirements.

For example, a Pontryagin minimum principle solution to the optimal control problem used by some embodiments, leads to a 'non-structured' solution, i.e., the shape (over time) of the control $l_c^{(2)}$ is dictated by the solution of the control problem. This is in contrast with the desirable usual shapes of the elevator motion trajectories used in actual elevators, which take into account passengers ride comfort and safety.

To that end, some embodiments simplify these requirements by assuming that the motion profile follows a predetermined pattern. Such a pattern restricts the variations of the motion profile simplifying the optimization.

Figure 6:
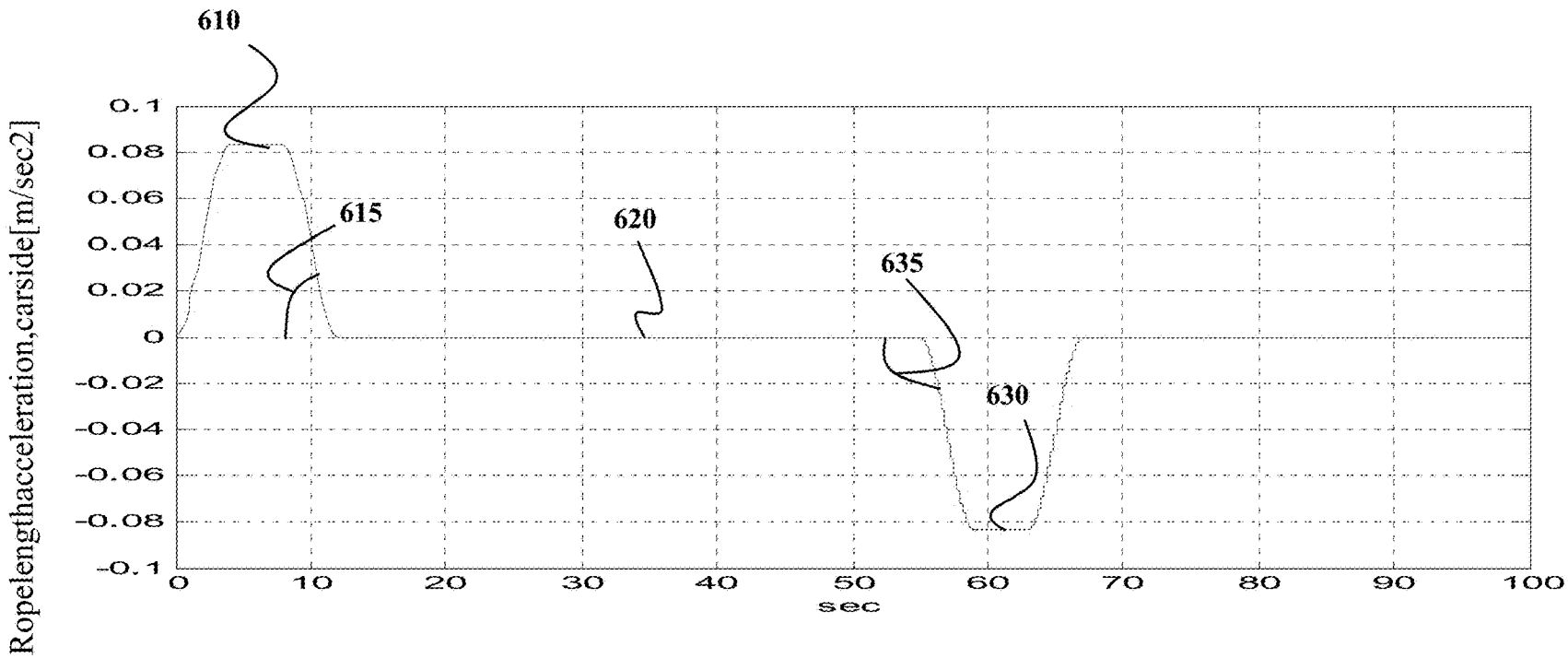
FIG. 6 shows an exemplar motion profile defined by a profile of the acceleration of the elevator car having a predetermined pattern according to some embodiment.

FIG. 6 shows an exemplar motion profile defined by a profile of the acceleration of the elevator car having a predetermined pattern according to some embodiment. This pattern includes a constant acceleration section 610 followed by a zero acceleration section 620 followed by a constant deceleration section 630. For this example, the parameters of the pattern determined for the requested change of length of the elevator rope include a slope of the acceleration 615, a slope of deceleration 635, and the length of each segment.

For example, the structural constraint impose by the pattern restricts to a set of optimization vectors:

$$(a,b,T_0,T_1,T_2,T_3,T_4,T_5,T_6)'\in\mathbb{R}^9,a>0,b<0.$$

Furthermore, to ensure a smooth motion of the elevator car, some embodiments impose symmetry of the first acceleration/deceleration phase:

$$T_0=T_2$$

and symmetry of the second deceleration/acceleration phase:

$$T_4=T_6$$

This further reduces the set of optimization vectors to:

$$V_{op}(a,b,T_0,T_1,T_3,T_4,T_5)'\in\mathbb{R}^7,a>0,b<0$$

The functional optimization problem reduces to the following vectorial optimization problem:

$$\mathrm{Min}_{V_{op}} J(t,V_{op},Z)$$

under the differential algebraic inequalities constraints $$\dot{Z}=\begin{pmatrix} F(X,\ddot{\omega},U(V_{op}),Z_5,Z_6) \\ Z_6 \\ U(V_{op}) \end{pmatrix}$$

$$Z(t_0)=\left(X'(t_0),\ \tilde{X}'(t_0)\right)'$$

$$Z(t_f)=\left(X'(t_f),\ \tilde{X}'(t_f)\right)'$$

$$|Z_5(t)|\leq l_c(t_f),\ |Z_6(t)|\leq \dot{i}_{c_{max}},\ t\in[t_0,\ t_f]$$

$$|U(t)|\leq \ddot{i}_{c_{max}},\ t\in[t_0,\ t_f]$$

$$2T_0+T_1+T_3+2T_4+T_5=t_f$$

$$a>0,\ b<0$$

To that end, some embodiments select the following cost function $$J=Q_1(\max_{[t_0,t_f]}|Z_1|)^2+Q_2(\max_{[t_0,t_f]}|Z_3|)^2+Q_3(Z(5)(t_f)-\tilde{X}_1(t_f))^2+Q_4t_f$$

$$Q_1>0,Q_2>0,Q_3>0,Q_4>0$$

where the term $Q_1(\max_{[t_0,t_f]}|Z_1|)^2$ is added to minimize the cable sway at the wall side; the term $Q_2(\max_{[t_0,t_f]}|Z_3|)^2$ is added to minimize the cable sway at the car side; the term $Q_3(Z(5)(t_f)-\tilde{X}_t(t_f))^2$ is added to avoid the trivial stationary solution, i.e. the car not moving; and the term $Q_4t_f$ is added to seek the shortest optimal motion time.

The existence of at least a local optimum of the structured optimal control problem, is ensured from basic continuity of the solutions of the system's dynamics as function of the optimization parameters, and the search of the parameters in a compact set, i.e., the search of the optimal solution is limited to box constraints on each parameter.

Figure 7:
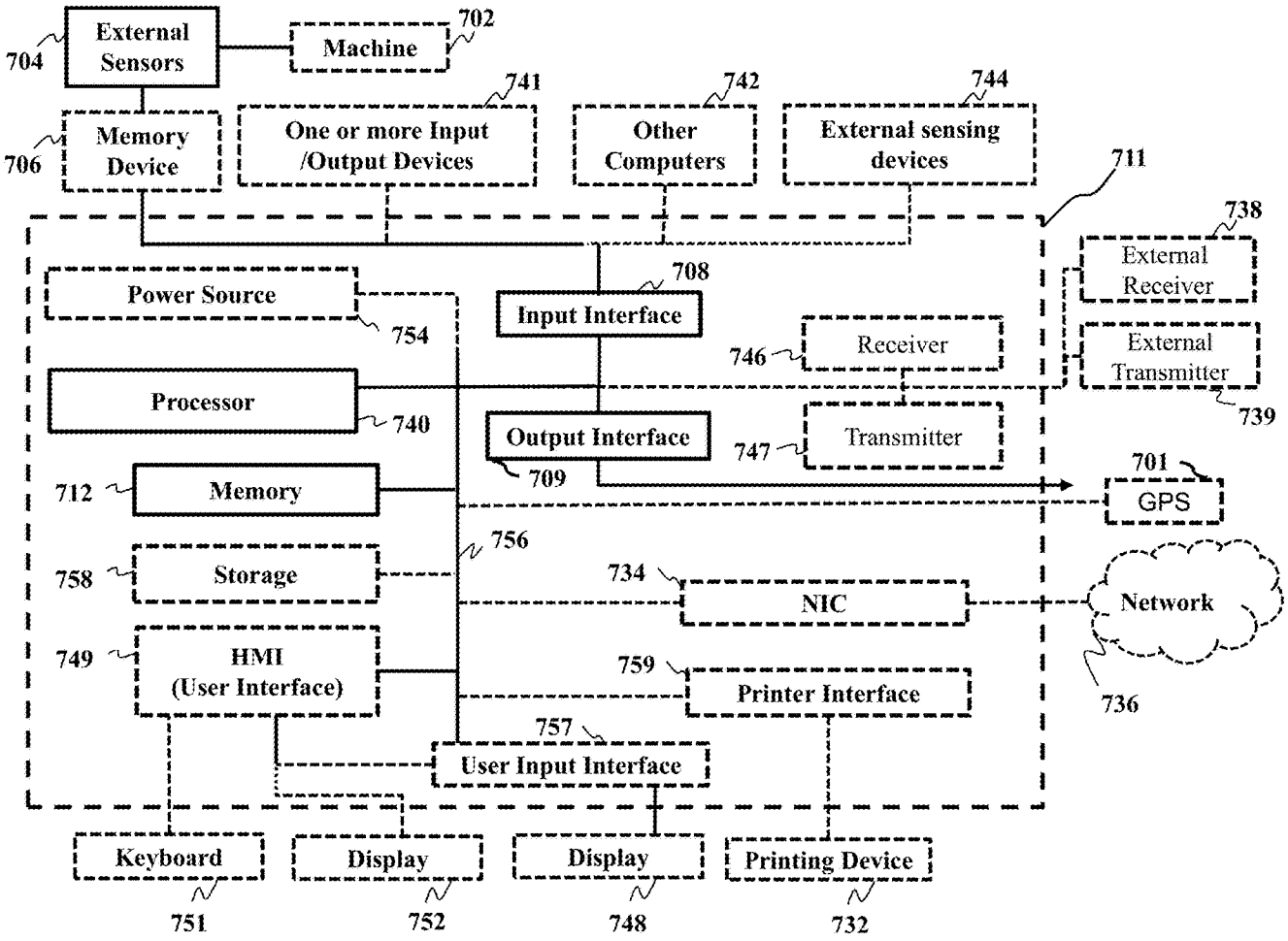
FIG. 7 is a block diagram of a control system for controlling the elevator systems that can be implemented using an alternate computer or processor according to embodiments.

FIG. 7 is a block diagram of a control system for controlling the elevator systems that can be implemented using an alternate computer or processor according to embodiments. The computer 711 includes a processor 740, computer readable memory 712, storage 758 and user interface 749 with display 752 and keyboard 751, which are connected through bus 756. For example, the user interface 749 in communication with the processor 740 and the computer readable memory 712, acquires and stores the data (i.e., data relating to controlling movement of the elevator cars or elevator systems, elevator system operational historical data, elevator system optimization related data related to assigning halls calls to elevator cars of a similar elevator system), in the computer readable memory 712 upon receiving an input from a surface, keyboard surface, of the user interface 757 by a user.

Contemplated is that the memory 712 can store instructions that are executable by the processor, historical data, and any data to that can be utilized by the methods and systems of the present disclosure. The processor 740 can be a single core processor, a multi-core processor, a computing cluster, or any number of other configurations. The processor 740 can be connected through a bus 756 to one or more input and output devices. The memory 712 can include random access memory (RAM), read only memory (ROM), flash memory, or any other suitable memory systems.

Still referring to FIG. 7, a storage device 758 can be adapted to store supplementary data and/or software modules used by the processor. For example, the storage device 758 can store historical data and other related data such as manuals for the devices of the elevator system or similar types of elevator systems, wherein the devices can include sensing devices capable of obtaining data as mentioned above regarding the present disclosure. Additionally, or alternatively, the storage device 758 can store historical data similar to the data. The storage device 758 can include a hard drive, an optical drive, a thumb-drive, an array of drives, or any combinations thereof.

The system can be linked through the bus 756 optionally to a display interface (not shown) adapted to connect the system to a display device (not shown), wherein the display device can include a computer monitor, camera, television, projector, or mobile device, among others.

The computer 711 can include a power source 754, depending upon the application the power source 754 may be optionally located outside of the computer 711. Linked through bus 756 can be a user input interface 757 adapted to connect to a display device 748, wherein the display device 748 can include a computer monitor, camera, television, projector, or mobile device, among others. A printer interface 759 can also be connected through bus 756 and adapted to connect to a printing device 732, wherein the printing device 732 can include a liquid inkjet printer, solid ink printer, large-scale commercial printer, thermal printer, UV printer, or dye-sublimation printer, among others. A network interface controller (NIC) 734 is adapted to connect through the bus 756 to a network 736, wherein measuring data or other data, among other things, can be rendered on a third party display device, third party imaging device, and/or third party printing device outside of the computer 711.

Still referring to FIG. 7, the data or other data, among other things, can be transmitted over a communication channel of the network 736, and/or stored within the storage system 758 for storage and/or further processing. Further, the measuring data or other data may be received wirelessly or hard wired from a receiver 746 (or external receiver 738) or transmitted via a transmitter 747 (or external transmitter 739) wirelessly or hard wired, the receiver 746 and transmitter 747 are both connected through the bus 756. The computer 711 may be connected via an input interface 708 to external sensing devices 744 and external input/output devices 741. The computer 711 may be connected to other external computers 742, sensors 704 sensing the operation of the elevator system and/or other machines 702. An output interface 709 may be used to output the processed data from the processor 740.

The above-described embodiments can be implemented in any of numerous ways. For example, the embodiments may be implemented using hardware, software or a combination thereof. When implemented in software, the software code can be stored on a non-transient computer readable memory and executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Computer-executable instructions may be in many forms, such as program modules, executed by one or more computers or other devices. Generally, program modules include routines, programs, objects, components, and data structures that perform particular tasks or implement particular abstract data types. Typically, the functionality of the program modules may be combined or distributed as desired in various embodiments.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

I claim:

1. A method for controlling an operation of an elevator system including an elevator car supported by an elevator rope wrapped around a sheave, such that a rotation of the sheave changes a length of the elevator rope between the sheave and the elevator car thereby controlling a movement of the elevator car within an elevator shaft of the elevator system, and at least one elevator cable connected to the elevator car and the elevator shaft to carry electrical signals to the elevator car, wherein the method uses a processor coupled with stored instructions implementing the method, wherein the instructions, when executed by the processor carry out at least some steps of the method, comprising:

receiving a call for a movement of the elevator car requesting a change of the length of the elevator rope;

accessing a model of a cable relating a sway of the cable to a motion profile of an elevator car defining one or combination of the length, a velocity, and an acceleration of the elevator rope as a function of time;

determining the motion profile of the elevator car causing the requested change of the length of the elevator rope that reduces the sway of the cable according to the model of the cable; and controlling the motion of the elevator car according to the determined motion profile.

2. The method of claim 1, wherein the determining comprises:

selecting the motion profile from a memory storing a mapping between different motion profiles and different values of the requested change of the length of the elevator rope.

3. The method of claim 1, wherein the model of the cable includes a disturbance on the elevator system, further comprising:

measuring the disturbance on the elevator system using a sensor measuring an acceleration of a sway of the building;

solving an optimization problem minimizing a cost function of the sway of the cable subject to constraints defined by the model of the cable to produce the motion profile.

4. The method of claim 3, wherein the cost function includes a time of motion of the elevator car that causes the requested change of the length of the elevator rope.

5. The method of claim 1, wherein the model of the cable includes $$\dot{X}=F(X,\ddot{\omega}(t),l_c^{(2)},l_c^{(1)},l_c),$$

Wherein, F is a function representing a mathematical model of the cable system, X represents the states of the cable system, e.g., sway of the cable at the wall side, sway of the cable at the car side, velocity of the sway of the cable at the wall side, velocity of the sway of the cable at the car side, $\ddot{\omega}(t)$ is the external disturbance acceleration, $l_c^{(2)},l_c^{(1)},l_c$, represents the elevator rope length acceleration, velocity, and length.

6. The method of claim 1, wherein the motion profile is defined by a profile of the acceleration of the elevator car having a predetermined pattern, wherein the determining includes determining parameters of the predetermined pattern.

7. The method of claim 6, wherein the pattern includes a constant acceleration section followed by a zero acceleration section followed by a constant deceleration section, and wherein the parameters include a slope of the acceleration, a slope of deceleration, and the length of each segment.

8. An elevator system comprising:

an elevator car supported by an elevator rope wrapped around a sheave, such that a rotation of the sheave changes a length of the elevator rope between the sheave and the elevator car thereby controlling a movement of the elevator car within an elevator shaft of the elevator system;

a motor to control a rotation of the sheave changing the length of the elevator rope;

at least one elevator cable connected to the elevator car and the elevator shaft;

at least one input interface for accepting a request of the elevator car to move from a current position in the elevator shaft to a different position necessitating a change of the length of the elevator rope;

a memory to store a model of a cable as a function of a sway of the cable and a motion profile of an elevator car defining one or combination of the length, a velocity, and an acceleration of the elevator rope as a function of time; and a controller including a processor to determine the motion profile of the elevator car causing the requested change of the length of the elevator rope that reduces the sway of the cable according to the model of the cable, and to cause the motor to rotate the sheave and to move the elevator car according to the determined motion profile.

9. The system of claim 8, wherein the memory stores a mapping between different motion profiles and different values of the requested change of the length of the elevator rope, and wherein the controller selects the motion profile corresponding the requested change of the length of the elevator rope from the mapping.

10. The system of claim 8, wherein the model of the cable includes $$\dot{X}=F(X,\ddot{\omega}(t),l_c^{(2)},l_c^{(1)},l_c),$$

Wherein, F is a function representing a mathematical model of the cable system, X represents the states of the cable system, e.g., sway of the cable at the wall side, sway of the cable at the car side, velocity of the sway of the cable at the wall side, velocity of the sway of the cable at the car side, $\ddot{\omega}(t)$ is the external disturbance acceleration, $l_c^{(2)},l_c^{(1)},l_c$, represents the elevator rope length acceleration, velocity, and length.

11. The system of claim 8, wherein the motion profile is defined by a profile of the acceleration of the elevator car having a predetermined pattern, wherein the determining includes determining parameters of the predetermined pattern.

12. The system of claim 11, wherein the pattern includes a constant acceleration section followed by a zero acceleration section followed by a constant deceleration section, and wherein the parameters include a slope of the acceleration, a slope of deceleration, and the length of each segment.

13. The system of claim 8, wherein the model of the cable includes a disturbance on the elevator system, further comprising:

a sensor to measure the disturbance on the elevator system, wherein the controller solves an optimization problem minimizing a cost function of the sway of the cable subject to constraints defined by the model of the cable to produce the motion profile.

14. The system of claim 13, wherein the cost function includes a time of motion of the elevator car that causes the requested change of the length of the elevator rope.

15. A non-transitory computer readable storage medium embodied thereon a program executable by a processor for performing a method, wherein the memory stores a set of analytical functions and a set of cost functions corresponding to a set of patterns of elementary paths, each pattern represents a continuous path, each analytical function is determined for a corresponding pattern to provide an analytical solution for input states of the vehicle defining a continuous path connecting the input states by a sequential compositions of the elementary paths following the corresponding pattern, and each cost function is determined to provide a cost of the corresponding pattern indicative of a cost of the motion of the vehicle according to the continuous path connecting the input states and represented by the corresponding pattern, the method comprising:

receiving a call for a movement of the elevator car requesting a change of the length of the elevator rope;

accessing a model of a cable relating a sway of the cable to a motion profile of an elevator car defining one or combination of the length, a velocity, and an acceleration of the elevator rope as a function of time;

determining the motion profile of the elevator car causing the requested change of the length of the elevator rope that minimizes the sway of the cable according to the model of the cable; and controlling the motion of the elevator car according to the determined motion profile.

* * * * *